US005142184A

United States Patent [19]

Kane

[11] Patent Number: 5,142,184

[45] Date of Patent: Aug. 25, 1992

[54] COLD CATHODE FIELD EMISSION DEVICE WITH INTEGRAL EMITTER BALLASTING

[76] Inventor: Robert C. Kane, 10916 Pheasant La., Woodstock, Ill. 60098

[21] Appl. No.: 477,695

[22] Filed: Feb. 9, 1990

[51] Int. Cl.[5] ..... H01J 1/16

[52] U.S. Cl. ..... 313/309; 313/336

[58] Field of Search ..... 313/309, 336

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 3,894,332 | 7/1975 | Nathanson et al. | 29/578 |
| 3,921,022 | 11/1975 | Levine | 313/309 |
| 3,970,887 | 7/1976 | Gray et al. . | |
| 3,998,678 | 12/1976 | Fukase et al. | 156/3 |
| 4,008,412 | 2/1977 | Yuito et al. | 313/309 |
| 4,178,531 | 12/1979 | Alig | 313/409 |
| 4,307,507 | 12/1981 | Gray et al. | 29/580 |
| 4,513,308 | 4/1985 | Greene et al. | 357/55 |
| 4,578,614 | 3/1986 | Gray et al. | 313/308 |
| 4,685,996 | 8/1987 | Busta et al. | 156/628 |
| 4,721,885 | 1/1988 | Brodie | 313/576 |
| 4,827,177 | 5/1989 | Lee et al. | 313/306 |
| 4,874,981 | 10/1989 | Spindt | 313/309 |
| 4,884,010 | 11/1989 | Biberian | 313/309 X |
| 4,970,887 | 7/1976 | Smith et al. | 313/309 |

FOREIGN PATENT DOCUMENTS

| | | |
|---|---|---|
| 0172089 | 7/1985 | European Pat. Off. . |
| 2604823 | 10/1986 | France . |
| 855782 | 8/1981 | U.S.S.R. . |
| 2204991A | 11/1988 | United Kingdom . |

OTHER PUBLICATIONS

Advanced Technology: flat cold-cathode CRTs, by Ivor Brodie, Information Display Jan., 1989.

Field-Emitter Arrays Applied to Vacuum Flourescent Display, by Spindt et al. Jan, 1989 issue of IEEE Transactions on Electronic Devices.

Field Emission Cathode Array Development For High--Current Density Applications by Spindt et al., dated Aug., 1982 vol. 16 of Applications of Surface Science.

*Primary Examiner*—Sandra L. O'Shea

[57] ABSTRACT

A cold cathode field emission device that includes a ballast resistor (202, 303, 402) integrally formed therewith and coupled to the emitter (204, 302, 403) to allow appropriate compensation for manufacturing and performance variations in field emission from the attached emitter.

9 Claims, 1 Drawing Sheet

FIG. 2A
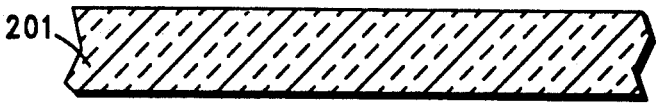
FIG. 2B
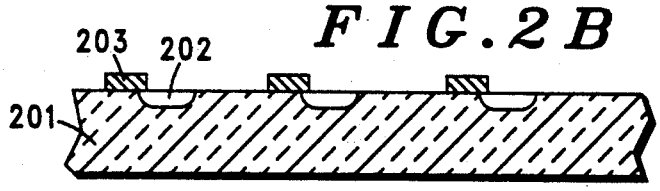
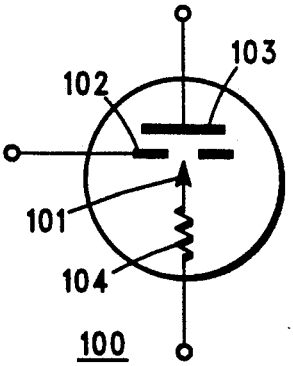
FIG. 1
FIG. 2C
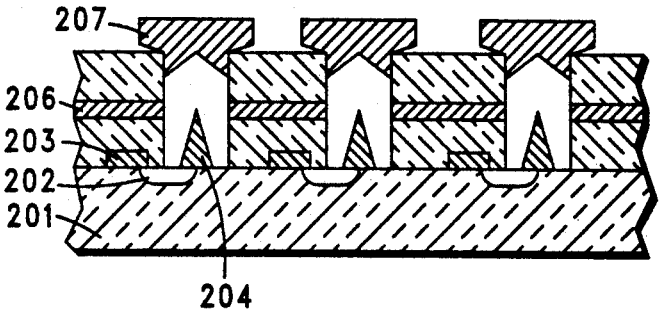
FIG. 3
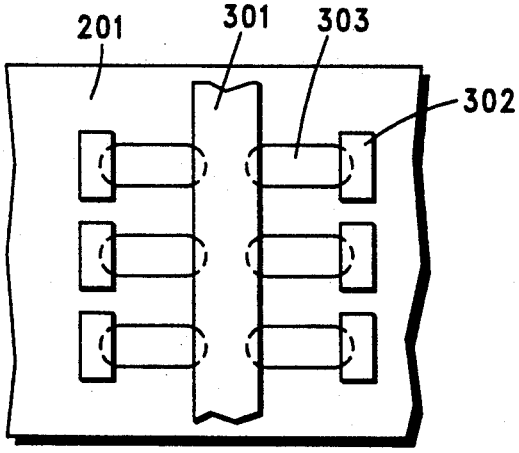
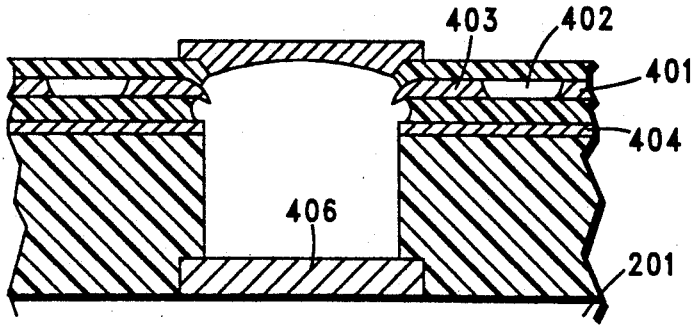
FIG. 4

COLD CATHODE FIELD EMISSION DEVICE WITH INTEGRAL EMITTER BALLASTING

TECHNICAL FIELD

This invention relates generally to cold cathode field emission devices.

BACKGROUND OF THE INVENTION

Cold cathode field emission devices are known. In general, such devices include at least two electrodes (a cathode (emitter) and an anode (collector) or three electrodes (the previous two electrodes and a gate)).

Various architectures have been proposed for such devices, including devices wherein the various electrodes are configured substantially planar to one another, and substantially non-planar. Regardless of the configuration, prior art field emission devices (FEDs) often suffer from non-uniform electron emission at individual emitter tips. This problem is particularly noticeable when dealing with a plurality of emitter tips in a device array. This problem can result, in part, because the geometry of individual emitter tips can vary significantly from an intended norm. Some of these tips will be the source of the bulk of an overall emitter current and in some instances will be driven to destruction due to the high emission rate.

Therefore, a need exists for a readily manufacturable, cost efficient, and reliable solution to this problem.

SUMMARY OF THE INVENTION

Such a solution is substantially presented through provision of the cold cathode field emission device disclosed herein. Pursuant to this invention, the device has a ballast resistor formed integrally therewith, which ballast resistor couples to the emitter. Placing this resistive element in series with each emitter tip results in a proportional voltage rise at the tip as current emitted from that particular tip increases. This voltage rise will effectively reduce the gate/emitter potential and thereby reduce the enhanced electric field at the surface of the emitter. This process establishes an equilibrium and current limiting function that is independent for each tip in an array of such devices.

In one embodiment of the invention, the ballast resistor is formed on a semiconductor substrate through selective impurity diffusion, which may include phosphorous material.

The invention is applicable in integral context with either planar or non-planar geometry devices.

BRIEF DESCRIPTION OF THE DRAWINGS

FIG. 1 comprises a schematic symbol appropriate for use in depicting a field emission device constructed in accordance with the invention;

FIGS. 2*a–c* comprise side elevational sectioned depictions of various manufacturing phases of a substantially non-planar FED in accordance with the invention;

FIG. 3 comprises a top plan view of a portion of a substantially planar FED as manufactured in accordance with the invention; and FIG. 4 comprises a side elevational sectioned view of an alternative embodiment of a substantially non-planar FED as constructed in accordance with the invention.

BEST MODE FOR CARRYING OUT THE INVENTION

A schematic symbol useful for depicting an FED as instructed in accordance with the invention is depicted in FIG. 1 by the reference numeral 100. The device comprises an integral structure that includes an emitter (101), a gate (102), an anode (103), and a ballast resistor (104) that couples to the emitter.

Manufacture of a non-planar FED in accordance with the invention will be described with reference to FIGS. 2*a–c*. An appropriate initial substrate is provided, such as a silicon substrate (201) (FIG. 2*a*). Using appropriate semiconductor manufacturing methodology, as well understood by those skilled in the art, a diffusion process imparts phosphorus material (202) (FIG. 2*b*) or other appropriate dopant into selected portions of the substrate (201). This introduction of phosphorous material through selective impurity diffusion allows provision of the integrally manufactured ballast resistor into the FED as described below in more detail.

An initial emitter stripe metallization (203) can also be seen in FIG. 2*b*. (In alternative embodiments the emitter stripe may be realized through selective diffusion of appropriate dopant materials directly into the substrate layer.)

Various subsequent processing steps that yield a complete non-planar FED are understood in the art, and need not be presented here. In FIG. 2*c*, an array of completed non-planar FEDs can be seen, wherein each FED includes at least three electrodes, including an emitter (204), a gate (206), and an anode (207). The emitter (204) of each FED in the array couples to an emitter stripe (203) via a ballast resistor (202), the latter again comprising a ballast resistor of desired impedance.

So configured, non-conformities between emitter tips can be substantially compensated via the ballast resistors (202) that are coupled in series with each emitter (204).

A substantially planar FED as constructed in accordance with the invention will now be described with reference to FIG. 3. A silicon substrate (201) again provides an appropriate support media for construction of the device and, again, through selective impurity diffusion, an appropriate doping material, such as phosphorous, is introduced into various portions of the substrate (201) to form ballast resistors (303). A metallization process then follows to allow deposition of an emitter strip (301) and a plurality of individual emitter pads (302) that will function, in the finally completed device, as conductive bases for the emitter itself. (Construction of the remaining elements of the FEDs in this array need not be provided here; for additional details regarding such manufacturing steps, see U.S. Ser. No. 07/330,050, filed on Mar. 29, 1989.)

So configured, performance variations due to emitter tip construction can be substantially compensated in a plurality of FEDs through action of the ballast emitters (303) that are constructed integral to the FED structure itself.

In FIG. 4, an alternative embodiment of a substantially non-planar FED is depicted. This architecture again provides for a support substrate (201) and at least an emitter (403) that couples to an emitter stripe (401), a gate (404), and an anode (406). (Additional details regarding the manufacturing steps and mode of operation of such an embodiment are presented in more detail in U.S. Ser. No. 477,686 filed on even date herewith, entitled "Encapsulated Field Emission Device". In this embodiment, the ballast resistor does not constitute an integral portion of the support substrate (201). Instead, given the inverted geometry of such an embodiment, wherein a subsequent deposition layer supports the emitter (403), a ballast resistor (402) can be formed within that deposition layer to provide an appropriate resistive series coupling between the emitter (403) and the emitter stripe (401). So configured, the integrally formed ballast emitter (402) will again function as described above.

What is claimed is:

1. A cold-cathode field emission device having an anode, an emitter, and a ballast resistor formed integrally therewith and coupled to the emitter.

2. The device of claim 1 wherein the emitter couples through the ballast resistor to a voltage source.

3. The device of claim 1 wherein the device is formed on a semiconductor substrate, and wherein the ballast resistor is formed, at least in part, of the semiconductor substrate.

4. The device of claim 3 wherein the ballast resistor is formed, at least in part, through selective impurity diffusion of the semiconductor substrate.

5. The device of claim 4 wherein the selective impurity diffusion includes phosphorous material.

6. The device of claim 1 wherein the field emission device has a substantially planar geometry.

7. The device of claim 1 wherein the field emission device has a substantially non-planar geometry.

8. An electronic device having a plurality of cold-cathode field emission devices, each of these devices having an anode, an emitter, and a ballast resistor formed integrally therewith and coupled to the emitter.

9. A method of forming a cold-cathode field emission device having a ballast resistor coupled to an emitter thereof, comprising the steps of:

A) providing a semiconductor substrate;

B) forming the ballast resistor by selectively diffusing impurities in at least a part of the semiconductor substrate;

C) forming at least part of the cold-cathode field emission device on the semiconductor substrate such that an emitter thereof couples to the ballast resistor;

D) forming an anode.

* * * * *

US005142184B1

REEXAMINATION CERTIFICATE (2738th)

United States Patent [19] [11] B1 5,142,184

Kane [45] Certificate Issued Nov. 21, 1995

[54] COLD CATHODE FIELD EMISSION DEVICE WITH INTEGRAL EMITTER BALLASTING

[75] Inventor: Robert C. Kane, Woodstock, Ill.

[73] Assignee: Motorola, Inc., Schaumburg, Ill.

Reexamination Request:
No. 90/003,705, Jan. 31, 1995

Reexamination Certificate for:

| | |
|---|---|
| Patent No.: | **5,142,184** |
| Issued: | **Aug. 25, 1992** |
| Appl. No.: | **477,695** |
| Filed: | **Feb. 9, 1990** |

[51] Int. Cl.[6] ..... H01J 1/16

[52] U.S. Cl. ..... 313/309; 313/336

[58] Field of Search ..... 313/309, 336

[56] References Cited

U.S. PATENT DOCUMENTS 4,940,916 7/1990 Borel et al. ..... 313/306

*Primary Examiner*—Sandra L. O'Shea

[57] ABSTRACT

A cold cathode field emission device that includes a ballast resistor (202, 303, 402) integrally formed therewith and coupled to the emitter (204, 302, 403) to allow appropriate compensation for manufacturing and performance variations in field emission from the attached emitter.

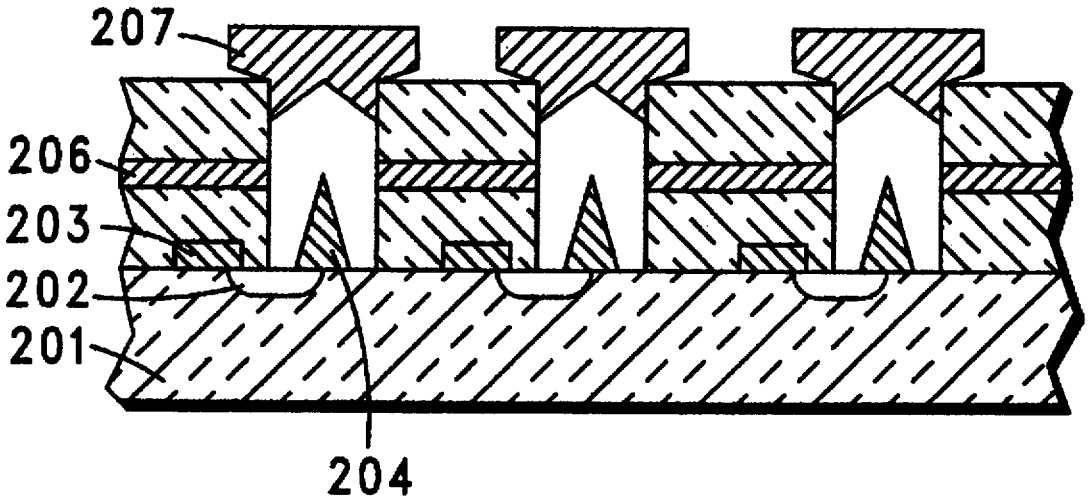

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2, 4, 5, 7 and 9 is confirmed.

Claims 1, 3, 6 and 8 are determined to be patentable as amended.

Claims 2, 4, 5 and 7, dependent on an amended claim, are determined to be patentable.

1. A cold-cathode field emission device having an anode, an emitter, and a ballast resistor formed integrally therewith and coupled to the emitter, *the ballast resistor being defined by a resistance extending laterally from electrical contact with the emitter to electrical contact with an emitter conductor and forming a lateral electrical path between the emitter and the emitter conductor.*

3. [The device of claim 1] *A cold-cathode field emission device having an anode, an emitter, and a ballast resistor formed integrally therewith and coupled to the emitter,* wherein the device is formed on a semiconductor substrate, and wherein the ballast resistor is formed, at least in part, of the semiconductor substrate.

6. [The device of claim 1] *A cold-cathode field emission device having an anode, an emitter, and a ballast resistor formed integrally therewith and coupled to the emitter,* wherein the field emission device has a substantially planar geometry.

8. An electronic device having a plurailty of cold-cathode field emission devices, each of these devices having an anode, an emitter, and a ballast resistor formed integrally therewith and coupled to the emitter, *the ballast resistor being defined by a resistance extending laterally from electrical contact with the emitter to electrical contact with an emitter conductor and forming a lateral electrical path between the emitter and the emitter conductor.*

* * * * *